United States Patent [19]

Flider

[11] 4,063,667

[45] Dec. 20, 1977

[54] NON-METALLIC SAFETY FILLING CONTAINER

[75] Inventor: Frank S. Flider, Mattoon, Ill.

[73] Assignee: Justrite Manufacturing Co., Des Plaines, Ill.

[21] Appl. No.: 645,431

[22] Filed: Dec. 30, 1975

[51] Int. Cl.[2] ..... B65D 47/00

[52] U.S. Cl. ..... 222/470; 222/475; 222/514

[58] Field of Search ..... 222/484, 470, 475, 514; 220/DIG. 14

[56] References Cited

U.S. PATENT DOCUMENTS

| | | | |
|---|---|---|---|
| 2,915,224 | 12/1959 | Beall | 222/484 X |
| 3,719,232 | 3/1973 | Gubela | 220/DIG. 14 |
| 3,794,235 | 2/1974 | Flider | 222/471 |
| 3,915,357 | 10/1975 | Zehr | 222/484 X |

FOREIGN PATENT DOCUMENTS

| | | | |
|---|---|---|---|
| 612,774 | 8/1926 | France | 222/484 |

*Primary Examiner*—Robert B. Reeves
*Assistant Examiner*—John P. Shannon
*Attorney, Agent, or Firm*—Alter and Weiss

[57] ABSTRACT

A non-metallic safety filling container is formed as a hollow wall having a continuously closed inner surface, terminating at openings for venting, pouring and filling. A trigger mechanism mounted to the container simultaneously vents the container and slides a ported cylinder into position to complete a pouring path from the interior of the container through the pour spout.

10 Claims, 6 Drawing Figures

NON-METALLIC SAFETY FILLING CONTAINER

This invention relates generally to plastic safety containers, and more specifically to an automatically self-venting safety container for controlledly dispensing volatile liquids, such as gasoline and the like.

Once-common hazards associated with transportation and storage of volatile liquids have substantially been alleviated through the introduction and use of storage and filling containers formed of non-metallic, easily moldable plastic material. Containers thus formed have no seams to rupture, are not subject to corrosion, will not dent, crack or cause sparks when dropped, and are much lighter than their erstwhile metallic counterparts. A properly designed and constructed plastic container is of substantially the same or greater strength and durability than a comparably designed metallic can, while at the same time being lighter and easier to handle.

A continuing problem exists, however, with the dispensing of liquids from storage containers, particularly where the liquids are extremely volatile or corrosive. Any splashing or spattering of such liquids could easily cause fire, explosion, or serious personal injury. Thus, storage containers for such liquids should provide not only a safe receptacle for storage and shipment, but should provide equally safe methods for controlledly dispensing volatile liquids.

Such a mechanism should, in its normal position, provide a positive closure, sealing the pour spout against accidental discharge of liquids or vapors; or intrusion of airborne impurities. To this end, the pour spout mechanism should be protectively mounted, ensuring that accidental blows or jars will not affect such a seal. The pour spout should also be designed to operate most easily and effeciently when the container is in a pouring attitude rather than when upright.

One method proven successful in dispensing such liquids is to provide a container which remains closed until placed in position for pouring. Such a device is the subject of U.S. Pat. No. 3,794,235, issued to the applicant herein, and assigned to the assignee of this invention, wherein a combination handle and trigger mechanism is provided to allow the container to be tipped into position before the pour spout is opened.

Thus, an important consideration in dispensing volatile liquids is to insure that the flow of liquid from the container is continuous and uniform, without surges or excessive turbulence, to avoid splashing or spattering. Maintaining such a flow from a closed container requires that the container be vented during pouring to allow air to enter the container as the liquid leaves it. A dispensing mechanism which allows such venting to be carried out automatically and with one hand, if required, assures maximum control and ease of operation.

This invention has, therefore, the following objects:

to provide non-metallic, safety filling containers which are automatically self venting;

to provide such containers with easily manipulable trigger-like controls;

to provide such containers in forms which minimize the chance of intrusion of airborne impurities into the can during pouring;

to provide such containers in forms which minimize the hazard of allowing volatile vapors to escape from the container during pouring;

to provide such containers in forms positionable in pouring attitudes before actual pouring commences;

to provide such containers with positively closing pour spout mechanisms controlled by trigger-like controls;

to provide such containers with the pour spouts extending from the side of the container;

to provide such containers with pour spout mechanisms effectively surrounded and protected by the pour spouts themselves;

to provide such containers with trigger-like controls which simultaneously vent the container while positioning a ported cylinder to complete a path of flow from the interior of the container through the pour spout; and to provide such containers manipulable with one hand.

These and other advantages will become more apparent upon consideration of the accompanying drawings, wherein.

Figure 1:
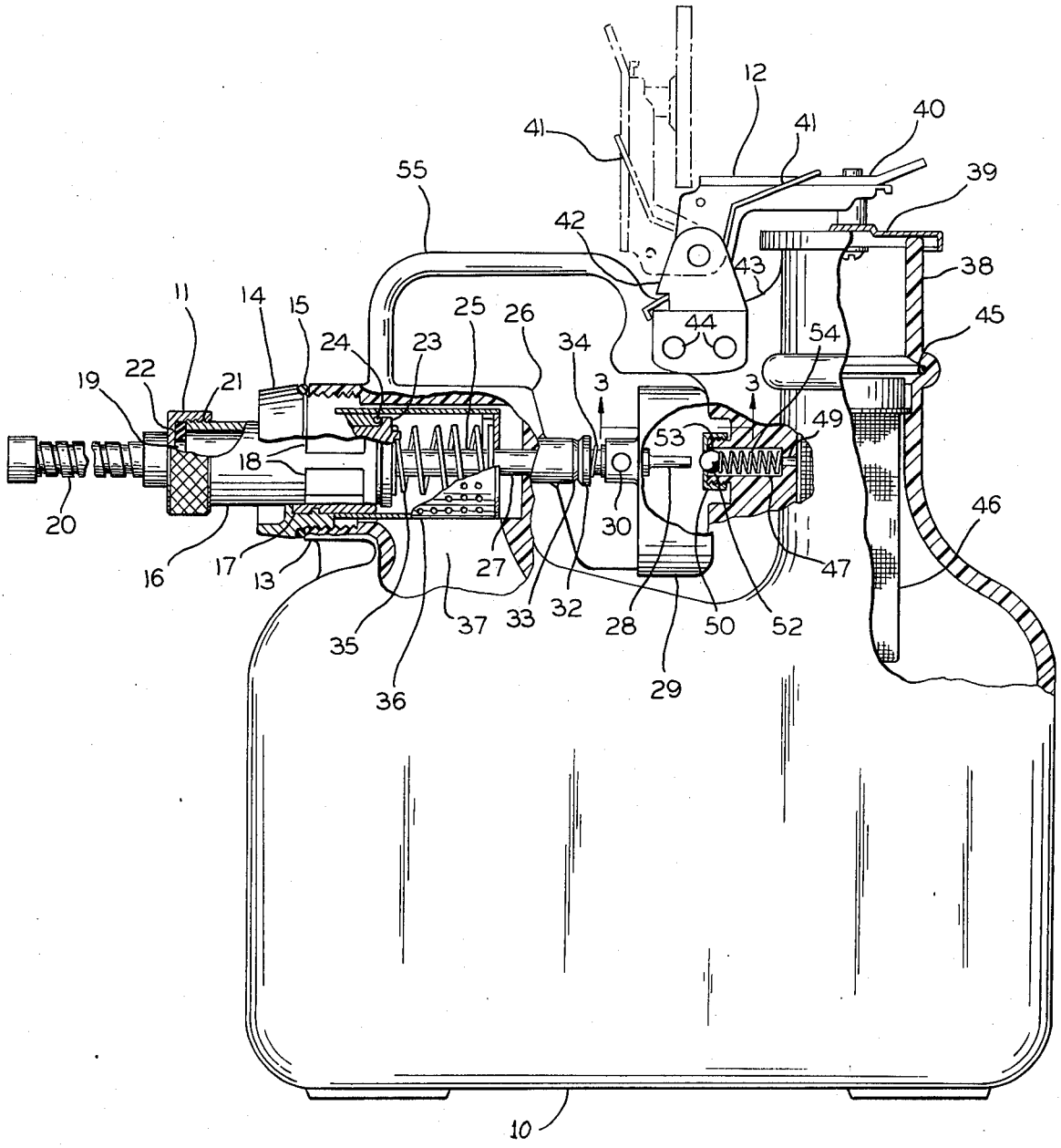
FIG. 1 is a partial section of the inventive container, illustrating the pour valve and vent shaft assembly.

In furtherance of the foregoing objects and descriptions, applicant herein provides a safety container 10 with an all plastic wall, as illustrated in FIG. 1, having separate openings for filling 38, venting 47, and pouring 13. Slidable sealing means 16 cooperates with pour opening 13, and trigger means 29, to complete a pour path through pour opening 13 while substantially simultaneously venting said safety container through vent opening 47. Check means 53 seals off vent 47, except during pouring operations, and fill opening 38 is opened only during filling, not during pouring.

Referring now to FIG. 1, the numeral 10 refers generally to a non-metallic safety filling container having pour spout assembly 11 and fill and vent assembly 12. Container 10 is preferably blow molded from high density polyethelyne to form a strong, yet extremely light weight, container.

Pour spout assembly 11 is threadably mounted to spout 13 of can 10 by valve guide 14. Gasket 15, herein illustrated as an O-ring, ensures a fluid-tight fit between spout 13 and valve guide 14.

Figure 2:
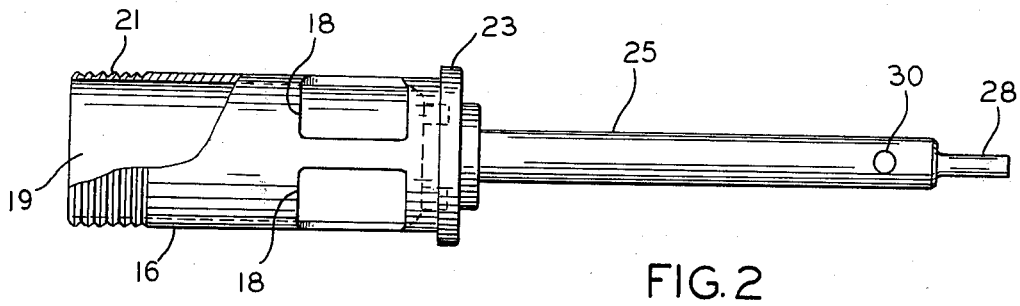
FIG. 2 is a partial section of the ported valve cylinder and shaft assembly.
Figure 3:
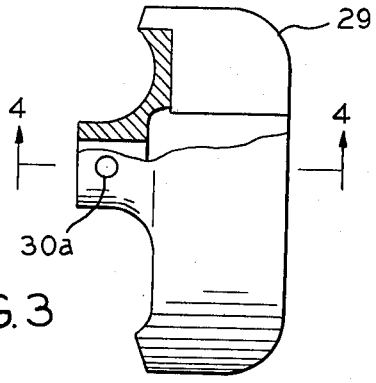
FIG. 3 is a partial section detailing the construction of the trigger.
Figure 4:
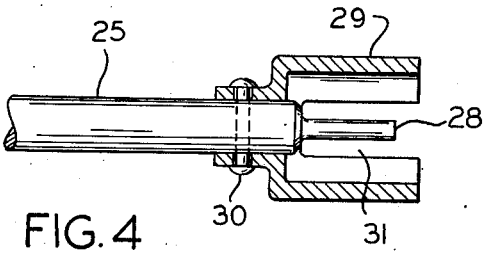
FIG. 4 is a section taken along 4—4 of FIG. 3, showing the valve shaft in place.

Valve cylinder 16 extends slidably through valve guide 14 and is held in alignment by valve guide insert 17. As illustrated at FIG. 2, a communicating passageway is formed through valve cylinder 16 by ports 18 and pour opening 19. Hose assembly 20 threadably engages valve cylinder 16 at 21; gasket 22 is used to effect a fluid-tight seal therebetween. At its opposite end, valve cylinder 16 has formed thereon retaining lip 23, which abuts valve guide gasket 24 when valve cylinder 16 is fully extended. Gasket 24 provides a fluid-tight seal between valve cylinder 16 and valve guide 17. Shaft 25, integrally fastened to valve cylinder 16, extends rearwardly, passing through rear spout wall 26, as shown at 27. As illustrated in FIG. 2, shaft 25 terminates in plunger 28. Plunger 28 is coaxial with valve shaft 25, but is substantially smaller in cross-sectional area. Trigger handle 29 is attached to shaft 25 by rivet 30, through rivet hole 30a, and, as shown in FIGS. 3 and 4, is hollow in cross-section to form chamber 31 which houses plunger 28. Ring seal 32 and washer 33 are secured in place by retaining spring 34 to form a fluid-tight seal at the point where shaft 25 passes through rear spout wall 26. Cylinder retaining spring 35 urges valve cylinder 16 forward into abutment with valve guide 17 at lip 23 to form a similar seal. Flame arrester 36, with apertures formed therein, is aligned in spout 13 to coaxially surround shaft 25 in spout throat 37.

Vent and fill assembly 12 consists of fill pipe 38 integrally formed on container 10, closeably sealed by vent cap 39 fastened to cover bracket assembly 40. Cover bracket spring 41 holds cover bracket assembly 40 in position when closed or when open, as shown in phantom at 41. Mounting bracket 42 pivotally accommodates mounting bracket assembly 40 and is fastened to fin 43 of container 10 by rivets 44.

Since fin 43 is formed on the exterior of container 10, rivet 44 may be used to fasten such hardware as mounting bracket 42 without penetrating to the interior of container 10, thus maintaining its fluid-tight integrity.

Annular groove 45 formed in fill pipe 38 accommodates flame arrester 46, shown herein as a stainless steel mesh cylinder open at its upper end. Flame arrester 46 also acts as a filter, removing impurities as container 10 is filled.

Vent chamber 47, formed in the forward wall 48 of fill pipe 38, communicates with fill pipe 38 via vent aperture 49. As detailed in this embodiment, vent aperture 49 has a diameter of .040 inches and is substantially smaller in diameter than vent aperture 47. Screw cap 50, with aperture 51 formed therein, is threadably fastened to nipple 42, thereby forming an extended portion of vent aperture 47. Vent ball 53, larger in diameter than aperture 51, is urged into aperture 51 by vent retaining spring 54, thereby forming a substantially airtight seal.

Handle 55, formed as an integral part of container 10, is provided for ease in transportation and handling.

Figure 5:
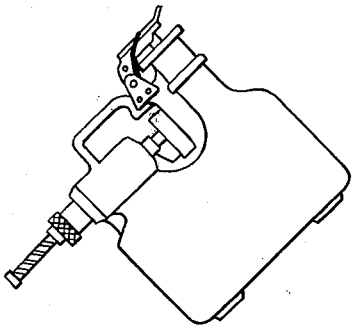
FIG. 5 illustrates the inventive container held in position prior to pouring.
Figure 6:
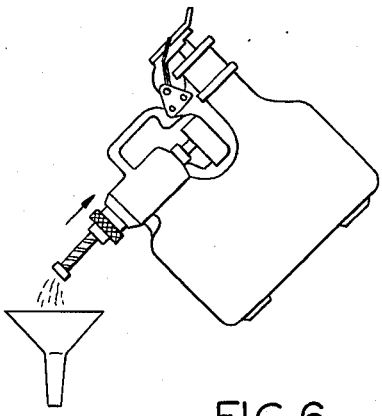
FIG. 6 illustrates the inventive container held in position while liquid is being dispensed therefrom.

Use of container 10 is particularly desirable where splash free pouring is required as, for example, with volatile liquids wherein splashing or spattering may lead to fire or explosion. With the present invention, a user can position the container in a pouring attitude before actual pouring commences, as shown in FIG. 5, thus eliminating the hazards inherent in adjusting the direction of flow by moving a container while pouring.

To dispense a volatile liquid from container 10, the user first grasps container 10 at trigger 29. Applying pressure to trigger 29 draws shaft 25 rearwardly, against the force exerted by retaining spring 35, thereby drawing valve cylinder 16 to a rearward position as shown in FIG. 4. In this position, a complete passageway communicating with the interior of container 10 is formed by hose assembly 20, the hollow portion of valve cylinder 16, portals 18 formed in valve cylinder 16, and spout throat 37. Completing such a passageway is, however, not enough to assure a smooth flow of fluid from the container. A vent to the atmosphere must also be provided.

Formerly, providing such a vent would require opening cover bracket assembly 40 or a movable portion thereof, resulting in a second separate operation to be completed before pouring is carried out. This resulted in exposing the contents of the can to the atmosphere, allowing potentially dangerous vapors to escape, or airborne impurities to enter. The present invention, however, accomplishes venting simultaneously with the movement of trigger 29. Plunger 28 formed on shaft 25 abuts vent ball 48 through aperture 51, and pushes it rearwardly against the force exerted by retaining spring 47. Aperture 51 is larger in diameter than plunger 28, and a vent passage is thus formed by aperture 51, chamber 47 and passageway 49. When the pouring operation is complete, the user releases trigger 29, and retaining springs 47 and 35 urge vent ball 53 and valve cylinder 16, respectively, back into closed positions. Thus, dispensing a volatile liquid from a storage container embodying the present invention can be carried out safely, conveniently and with the use of only one hand, if required.

It is to be expected that variations within the spirit and scope of the present invention will become apparent to those skilled in the art. It should therefore be understood that the foregoing description is by way of example only and is not intended to limit the scope of the present invention.

I claim:

1. A plastic safety container having a wall with a continuously closed inner surface, comprising:

separate openings formed in said wall for filling, venting, and pouring from said container, the first of said openings, used for filling said container, located on the top of said container and comprising a cylindrical upstanding tube extending into said container;

the second of said openings, used for emptying said container, being located on the side of said container and comprising a substantially horizontal tube extending from an open end into said container; and the third of said openings, used for venting said container, forming a communicating passageway between the exterior and interior wall surfaces of said container;

means for sealing said second of said openings, said sealing means slidably engaged within said second of said openings to selectively seal and unseal said second of said openings;

means for controlling the sliding of said sealing means, said control means mounted to the exterior of said container; and a single shaft having two ends, the first of said ends attached to said seal means, the second of said ends attached to said control means; and means for venting said third of said openings, said venting means positioned within the third of said openings, said sealing means, said shaft said control means and said venting means being aligned in fixed spatial relationship whereby operating said control means draws said sealing means inwardly from said second of said openings to complete a pour path from the interior of said container while simultaneously operating said venting means to complete a venting passage from the interior of said container to the exterior.

2. The apparatus as recited in claim 1, wherein said sealing means is a cylinder, said cylinder having formed therethrough a communicating passageway such that when said cylinder is drawn partially inward from said second of said openings a pour path is completed through said cylinder and said opening from the interior of said container to the exterior.

3. The apparatus as recited in claim 2 wherein said cylinder is spring biased to rest normally in a position to interrupt said pour path.

4. In a safety container formed with an all plastic wall having a continuously closed inner surface having at least three openings formed therein, the improvement comprising:

a cylindrical upstanding filling tube extending into said container at the first of said openings;

a substantially horizontal pouring tube extending from an open end into said container at the second of said openings;

a hollow cylindrical seal coaxial with and slidably engaged partially within said horizontal tube, said seal forming a communicating passageway whereby when said seal is drawn axially into said horizontal tube, a pour path is completed through said passageway and said pouring tube from the interior of said container to the atmosphere, said seal being spring-biased to rest normally in a position to interrupt said pour path;

a shaft having two ends, the first of said ends integrally attached to said seal;

a trigger, said trigger mounted exteriorly on said upstanding filling tube, the second of said shaft ends being attached to said trigger; and a selectively defeatable vent valve within the third of said openings, said vent valve, said trigger, said shaft, and said seal being aligned whereby drawing on said trigger to axially move said seal to complete said pour path substantially simultaneously defeats said vent valve to complete a venting path therethrough.

5. The apparatus as recited in claim 4, wherein said vent valve is aligned with the second of said shaft ends such that when said trigger is activated, said second of said shaft ends defeats said vent valve.

6. The apparatus as recited in claim 4 wherein said cylinder, said trigger and said vent valve are arranged in fixed spatial relationship, one to the other, such that when said trigger is actuated, a pathway is completed extending from the atmosphere exterior of said container, through said defeated vent valve, to the interior of said container, thence through said openings in said cylinder, thence through said horizontal tube to atmosphere, thereby simultaneously completing a venting path and a path for fluid flow.

7. The apparatus as recited in claim 4, wherein said trigger is mounted to said upstanding tube to extend toward said horizontal tube, said trigger and said upstanding tube forming thereby a hand grip.

8. The apparatus as recited in claim 4, wherein said cylinder, said shaft, said trigger and said vent valve are aligned horizontally in fixed spatial relationship.

9. The apparatus as recited in claim 4 wherein said shaft comprises a single, non-articulated shaft.

10. The apparatus as recited in claim 8 wherein said pouring tube has further formed therein a fourth opening, said fourth opening horizontally aligned with said cylinder, said shaft, said trigger and said vent valve, whereby said shaft passes therethrough to extend a portion thereof exteriorly of said container.

* * * * *